US011344136B2

(12) United States Patent
Li

(10) Patent No.: US 11,344,136 B2
(45) Date of Patent: May 31, 2022

(54) CHILD CARRIER

(71) Applicant: Wonderland Switzerland AG, Steinhausen (CH)

(72) Inventor: Jian-Qun Li, Guangdong (CN)

(73) Assignee: Wonderland Switzerland AG, Steinhausen (CH)

( * ) Notice: Subject to any disclaimer, the term of this patent is extended or adjusted under 35 U.S.C. 154(b) by 43 days.

(21) Appl. No.: 16/910,052

(22) Filed: Jun. 23, 2020

(65) Prior Publication Data

US 2020/0397150 A1 Dec. 24, 2020

(30) Foreign Application Priority Data

Jun. 24, 2019 (CN) ..... 201910553079.3

(51) Int. Cl.
*A47D 1/02* (2006.01)
*A47D 1/00* (2006.01)

(52) U.S. Cl.
CPC ..... *A47D 1/023* (2017.05); *A47D 1/0085* (2017.05)

(58) Field of Classification Search
CPC ..... A47D 1/004; A47D 1/023; A47D 1/002; A47D 1/02
USPC ..... 297/59
See application file for complete search history.

(56) References Cited

U.S. PATENT DOCUMENTS

| | | | | |
|---|---|---|---|---|
| 1,943,037 | A * | 1/1934 | Overbey | A47D 1/023 297/38 |
| 5,584,529 | A * | 12/1996 | Cheng | A47C 4/24 297/38 |
| 7,393,050 | B2 * | 7/2008 | Li | A47D 1/002 297/148 |
| 2007/0194609 | A1 * | 8/2007 | Chen | A47D 1/023 297/16.1 |
| 2015/0313375 | A1 * | 11/2015 | Horst | A47D 1/004 297/183.6 |
| 2020/0128970 | A1 * | 4/2020 | Pujol | A47D 1/008 |

FOREIGN PATENT DOCUMENTS

| | | |
|---|---|---|
| CN | 103202632 B | 1/2016 |
| DE | 1 195 445 | 6/1965 |
| EP | 2 829 199 A1 | 1/2015 |

* cited by examiner

*Primary Examiner* — Sarah B Mcpartlin
(74) *Attorney, Agent, or Firm* — Winston Hsu

(57) ABSTRACT

The present invention discloses a child carrier including a supporting frame, a sliding base, and a seat. The sliding base is disposed on the supporting frame and slidable in a longitudinal direction of the supporting frame for driving the supporting frame to be folded up when the sliding base slides upward along the supporting frame. The seat is foldably assembled with the sliding base. As such, the present invention improves the operational convenience of the child carrier.

39 Claims, 16 Drawing Sheets

CHILD CARRIER

BACKGROUND OF THE INVENTION

1. Field of the Invention

The present invention relates to a child carrier, and more specifically, to a child carrier having a folding function.

2. Description of the Prior Art

Rapid developed economics and technology provide people with various consumer products, such as a child carrier.

In general, the child carrier not only allows a user to feed an infant sitting thereon conveniently, but also ensures safety of the infant. Thus, the child carrier has become more and more popular in infant caring.

In practical application, for improving convenience of storage or carrying of the child carrier, the child carrier is usually designed to be foldable.

However, a folding operation of the child carrier is usually complicated since a supporting frame of the child carrier cannot be folded together with a chair structure of the child carrier, so as to cause the user much inconvenience in folding or unfolding the child carrier.

In summary, it is necessary to design a child carrier to be folded or unfolded conveniently and quickly for solving the aforesaid problem.

SUMMARY OF THE INVENTION

An intended purpose of the present invention is to provide a child carrier having a folding function to reduce a user's burden in operating the child carrier.

For achieving the aforesaid purpose, the child carrier of the present invention includes a supporting frame, a sliding base, and a seat. The sliding base is disposed on the supporting frame and slidable in a substantially longitudinal direction of the supporting frame. The seat is foldably assembled with the sliding base. The supporting frame is driven to be folded up when the sliding base slides upward along the supporting frame.

In a variant embodiment, the seat includes a backrest portion and a seat portion. The backrest portion is movably pivoted to the sliding base. The seat portion is coupled to the backrest portion and selectively coupled to the sliding base. The backrest portion is rotatable relative to the seat portion when the seat portion is decoupled from the sliding base.

In a variant embodiment, the seat portion includes an engaging member having an engaging portion, and the engaging portion is operable to engage with the sliding base.

In a variant embodiment, the seat portion includes two engaging members located at left and right sides of the seat respectively and a pulling member having an end connected to the engaging member located at the left side of the seat, the other end of the pulling member is connected to the engaging member located at the right side of the seat, and a middle portion of the pulling member is exposed above the seat portion.

In a variant embodiment, the pulling member is a braided strap or a rope.

In a variant embodiment, the engaging portion extends from an axis to engage with the sliding base, and the axis is the same as the axis where the seat portion and the backrest portion are hinged to engage with the sliding base.

In a variant embodiment, the child carrier further includes an insert member and an actuator. The insert member is disposed on the backrest portion for selectively engaging with or disengaging from the sliding base. The actuator is operable to drive the insert member to be engaged with or be disengaged from the sliding base. The actuator is able to drive the insert member to move a first distance.

In a variant embodiment, the engaging member further has a driving portion, the driving portion is able to drive the insert member to move a second distance, and the second distance is longer than the first distance.

In a variant embodiment, the insert member is an iron wire or a steel wire.

In a variant embodiment, the child carrier further includes a pushing member disposed on the backrest portion and slidable upward and downward relative to the backrest portion. The pushing member has an upper end abutting against the insert member and a lower end coupling to the driving portion of the engaging member, and the pushing member is driven to push the insert member to be disengaged from the sliding base with a second distance when the engaging member is disengaged from the sliding base.

In a variant embodiment, the driving portion of the engaging member has a first inclined surface oblique to a sliding direction of the engaging member, the pushing member has a second inclined surface matching with the first inclined surface, and the driving portion drives the pushing member to slide upward via relative sliding of the first inclined surface on the second inclined surface.

In a variant embodiment, the seat further includes a handrail base and a link member. The link member, the seat portion, the handrail base and the sliding base cooperatively form a four bar linkage mechanism for performing a folding motion.

In a variant embodiment, the seat portion is pivoted to the sliding base at a first pivot point, the handrail base is pivoted to the sliding base at a second pivot point located above the first pivot point, the link member is pivoted to the handrail base at a third pivot point located in front of the second pivot point, and the link member is pivoted to the seat at a fourth pivot point located under the third point.

In a variant embodiment, the first pivot point is located at an upper end of the seat portion, the second pivot point is located at a rear end of the handrail base, the third pivot point is located at a middle portion of the handrail base, and the fourth pivot point is located at a front end of the seat portion.

In a variant embodiment, the handrail base and the sliding base are located at left and right sides of the seat portion, the link member is a U-shaped structure having an opening facing upward, a top portion located at a left side of the U-shaped structure is pivoted to the handrail base at the left side of the seat portion, a top portion located at a right side of the U-shaped structure is pivoted to the handrail base at the right side of the seat portion, and a front end of the seat portion is pivotably disposed in the U-shaped structure.

In a variant embodiment, an engaging slot is formed on one of the seat portion and the sliding base, an engaging rail is formed on the other of the seat portion and the sliding base corresponding to the engaging slot, the engaging rail is disengaged from the engaging slot after the seat is folded up, and the engaging rail is engaged with the engaging slot after the seat is unfolded.

In a variant embodiment, the engaging rail or the engaging slot is located at a middle portion of a side wall of the seat portion facing the sliding base.

In a variant embodiment, the supporting frame includes a foldable joint and a locking mechanism. The foldable joint is disposed on the supporting frame. The locking mechanism is disposed on the foldable joint for selectively locking the foldable joint.

In a variant embodiment, the supporting frame includes a first standing frame and a second standing frame, the foldable joint includes a first fixed portion and a second fixed portion, and the locking mechanism includes a locking portion, a locking member, and a releasing member. The second fixed portion is connected to the first fixed portion of the first standing frame on the foldable joint via a pivot shaft. The locking portion is disposed on one of the first fixed portion and the second fixed portion. The locking member is movably disposed on the other of the first fixed portion and the second fixed portion. The locking member is able to engage with the locking portion to lock the supporting frame in a using position, and the releasing member is operable to move relative to the locking member and release the locking member from the locking portion.

In a variant embodiment, the supporting frame includes a first standing frame and a second standing frame, the foldable joint includes a first fixed portion and a second fixed portion, and the locking mechanism includes a locking member and a releasing member. The second fixed portion is connected to the first fixed portion of the first standing frame on the foldable joint via a pivot shaft. The locking member is movably disposed between the first fixed portion and the second fixed portion to lock the supporting frame in a using position, and the releasing member is operable to move relative to the locking member and release the locking member from at least one of the first fixed portion and the second fixed portion.

In a variant embodiment, the child carrier further includes an unlocking driving member. The unlocking driving member is disposed on the sliding base. The unlocking driving member drives the locking mechanism to perform a release motion when the sliding base slides upward along the supporting frame.

In a variant embodiment, the unlocking driving member drives the releasing member to release the locking member from the locking portion for releasing the locking member or the foldable joint in the using position when the sliding base slides upward along the supporting frame.

In a variant embodiment, the supporting frame further includes a containing chamber and a guiding slot. The containing chamber is disposed on the standing frame for containing the releasing member. The guiding slot is communicated with the containing chamber. The guiding slot extends in a radial direction of the pivot shaft to be aligned with the unlocking driving member. The unlocking driving member slides along the guiding slot to drive the releasing member to release the locking member from the locking portion when the sliding base slides upward along the supporting frame.

In a variant embodiment, the unlocking driving member is a rib, a rod, a block, or a sheet.

In a variant embodiment, the locking member is an external gear, and the locking portion is an internal gear.

In a variant embodiment, the first fixed portion has a first rib formed thereon, the second fixed portion has a second rib formed thereon, and the first rib abuts against the second rib when first fixed portion and the second fixed portion are folded up to a predetermined position.

In a variant embodiment, the first rib is adjacent to a portion of the first fixed portion assembled with the first standing frame, and the second rib is adjacent to a portion of the second fixed portion assembled with the second standing frame.

In a variant embodiment, the child carrier further includes a blocking member. The blocking member is movably assembled with the sliding base to be movable at least between a blocking position and a releasing position. The sliding base is blocked in an upward direction when the blocking member is located at the blocking position, and the sliding base is able to slide upward when the blocking member is located at the releasing position.

In a variant embodiment, the blocking member is coupled to the supporting frame and the upper end of the sliding base to prevent the sliding base from sliding upward in the blocking position, and the blocking member is decoupled from the supporting frame and the sliding base to release the sliding base to be slidable upward in the releasing position.

In a variant embodiment, the seat is movable at least between a folding position and an unfolding position relative to the sliding base. The seat drives the blocking member from the releasing position to the blocking position when the seat is located at the unfolding position, and the seat is separate from the blocking member to make the blocking member switchable to the releasing position when the seat is switched to the folding position.

In a variant embodiment, an elastic sheet structure extends from the sliding base, the blocking member is formed on a free end of the elastic sheet structure, and the blocking member is switchable between the blocking position and the releasing position via elastic deformation of the elastic sheet structure.

In a variant embodiment, the blocking member is pivoted to the sliding base or the blocking member is slidably disposed on the sliding base.

In a variant embodiment, the blocking member rotates or slides leftward and rightward relative to the sliding base when the blocking member is switched between the blocking position and the releasing position.

In a variant embodiment, the child carrier further includes a returning member having a tendency to drive the blocking member from the blocking position to the releasing position, and the returning member drives the blocking member to the releasing position when the seat is switched to the folding position.

Compared with the prior art, the present invention adopts the design in which the sliding base is disposed on the supporting frame and is slidable longitudinally along the supporting frame and the seat is foldably assembled with the sliding base. In such a manner, when the sliding base slides upward along the supporting frame, the seat can be folded up together with the sliding base and the sliding base can drive the supporting frame to be folded up synchronously, so as to quickly complete the folding operation of the child carrier. Thus, it is very easy for the user to perform the folding operation of the child carrier, so as to improve the operational convenience of the child carrier.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
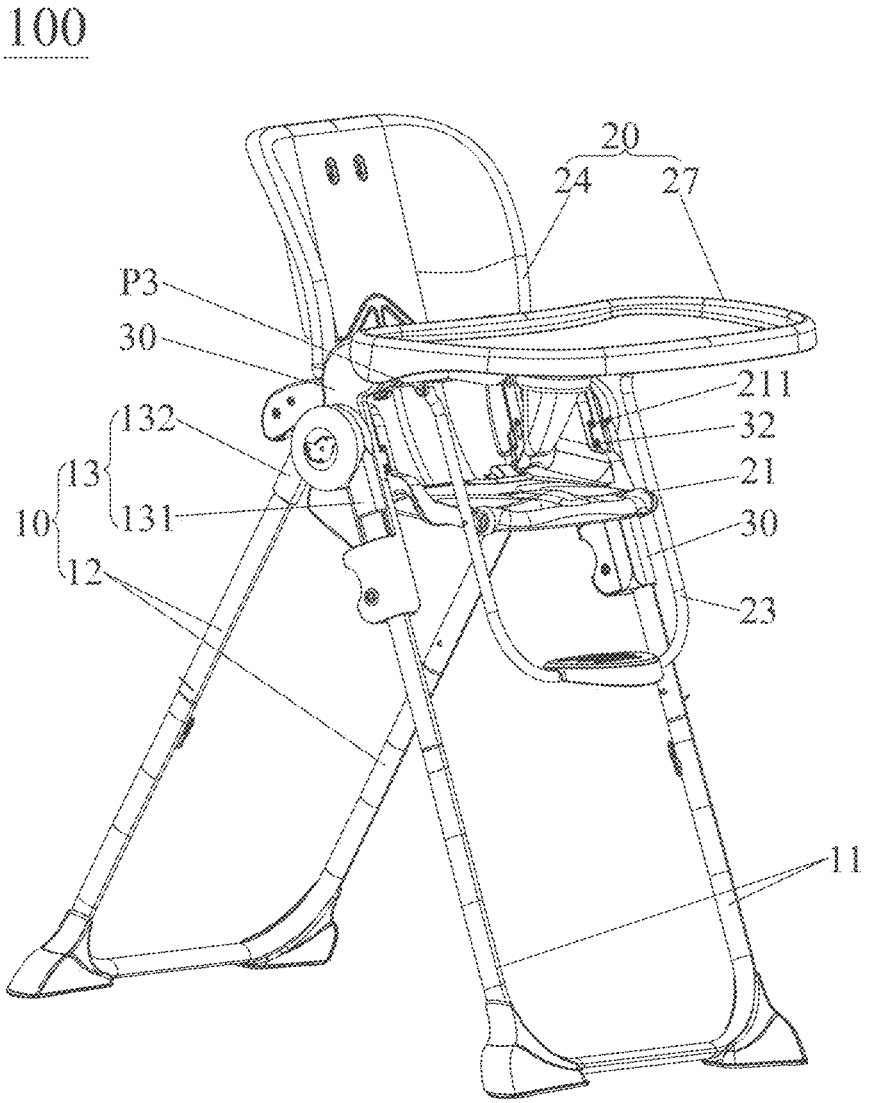
FIG. 1 is a diagram of a child carrier when a seat and a supporting frame are unfolded according to a preferred embodiment of the present invention.

The detailed description for preferred embodiments of the present invention is provided with attached drawings as follows.

A child carrier of the present invention includes a foldable supporting frame, a foldable seat, and a sliding base disposed on the supporting frame and slidable in a longitudinal direction of the supporting frame. The seat is assembled with the sliding base and is selectively foldable relative to the sliding base. The sliding base drives the supporting frame to be folded up when sliding upward along the supporting frame. Specifically, the supporting frame includes a first standing frame, a second standing frame, a foldable joint connected to the first standing frame and the second standing frame, and a locking mechanism disposed on the foldable joint for selectively locking or releasing the foldable joint. The sliding base is disposed on the first standing frame and has an unlocking driving member. The unlocking driving member drives the locking mechanism to perform a release motion when the sliding base slides upward along the supporting frame, so as to ensure the folding reliability of the first standing frame and the second standing frame via the foldable joint. At the same time, the first standing frame can be fixed at an unfolded position relative to the second standing frame via the locking mechanism for preventing accidental folding of the first standing frame and the second standing frame, so as to ensure operational safety of the child carrier. For example, the first standing frame and the second standing frame could be a U-shaped tube with an opening facing upward (but not limited thereto) for reducing the overall weight of the child carrier, simplifying the structural design of the child carrier, and ensuring the support reliability of the supporting frame for the seat. For preventing folding of the supporting frame caused by upward sliding of the sliding base when the seat is in an unfolded state, the child carrier of the present invention further includes a blocking member. The blocking member is movably assembled with the sliding base to be movable relative to the sliding base at least between a blocking position and a releasing position. When the blocking member is located at the blocking position, the blocking member abuts against the supporting frame for preventing the sliding base from sliding upward. When the blocking member is located at the releasing position, the blocking member is separate from the supporting frame to make the sliding base slidable upward. The seat is movable relative to the sliding base at least between a folding position and an unfolding position. When the seat is located at the unfolding position, the seat drives the blocking member to move from the releasing position to the blocking position. When the seat is switched to the folding position, the seat is separate from the blocking member to make the blocking member switchable to the releasing position. Accordingly, the seat and the supporting frame can be folded up sequentially for ensuring the folding sequence of the seat and the supporting frame, but not limited thereto.

The detailed description for the preferred embodiment of the present invention is provided as follows, and the derived designs for the child carrier including the seat, the supporting frame, and the sliding base according to other related embodiments may fall within the scope of the present invention.

Figure 13:
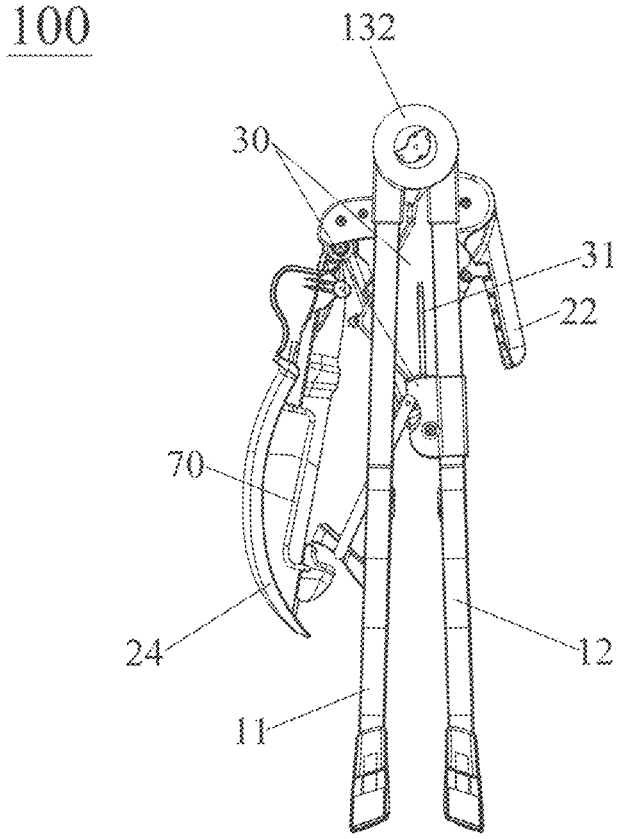
FIG. 13 is a diagram of the child carrier in FIG. 8 being completely folded up to a predetermined position.

Please refer to FIGS. 1-2 and FIGS. 14-15. The child carrier 100 according to a preferred embodiment of the present invention includes a foldable supporting frame 10, a foldable seat 20 and a sliding base 30 disposed on the supporting frame 10 and slidable in a longitudinal direction of the supporting frame 10. The seat 20 is assembled with the sliding base 30 and is foldable relative to the sliding base 30. Accordingly, the seat 20 can be folded up relative to the sliding base 30 when the seat 20 slides on the supporting frame 10 together with the sliding base 30. At the same time, the sliding base 30 can drive the supporting frame 10 to be folded up when sliding upward along the supporting frame 10. FIG. 13 shows that the supporting frame 10 is completely folded up.

Figure 14:
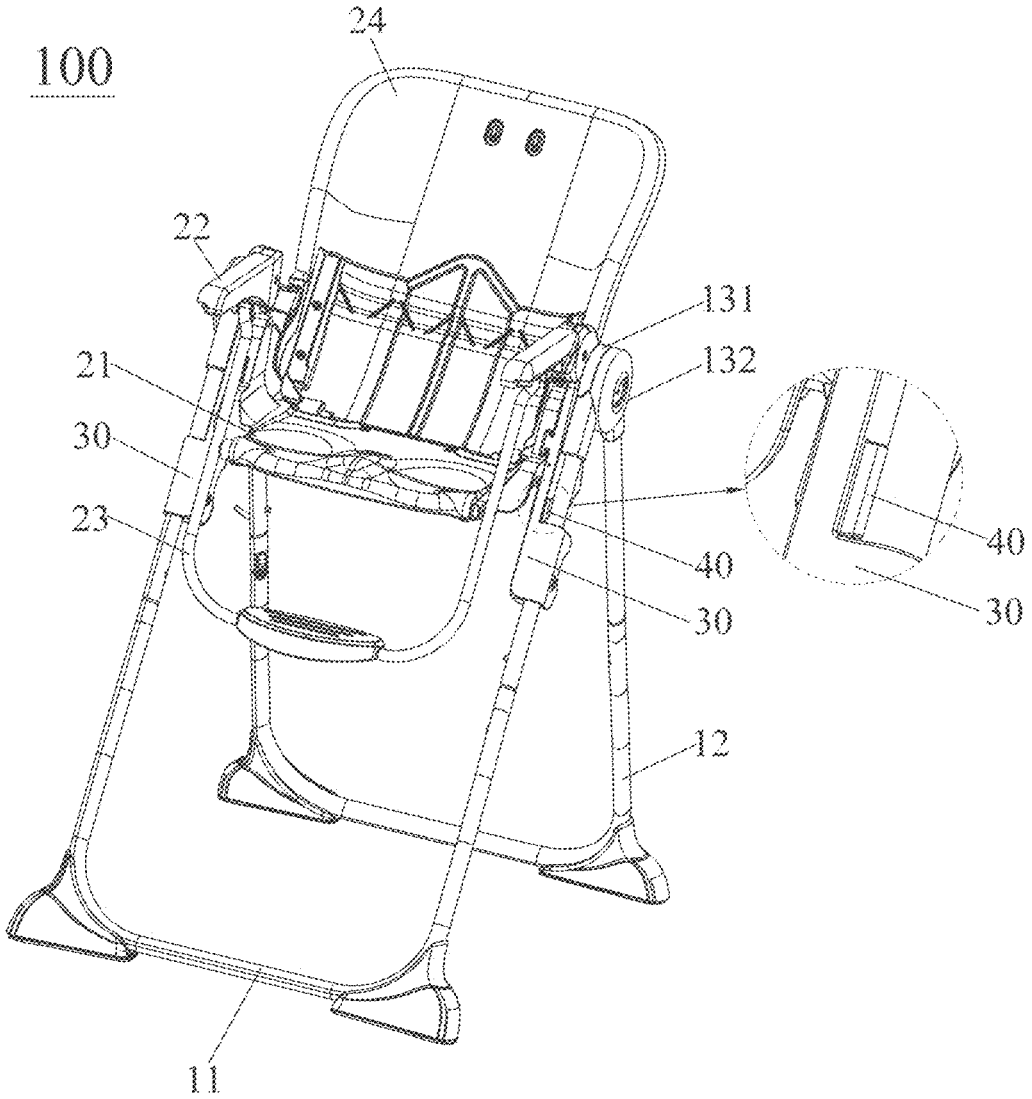
FIG. 14 is a diagram of a child carrier after a tray is detached according to a preferred embodiment of the present invention.
Figure 15:
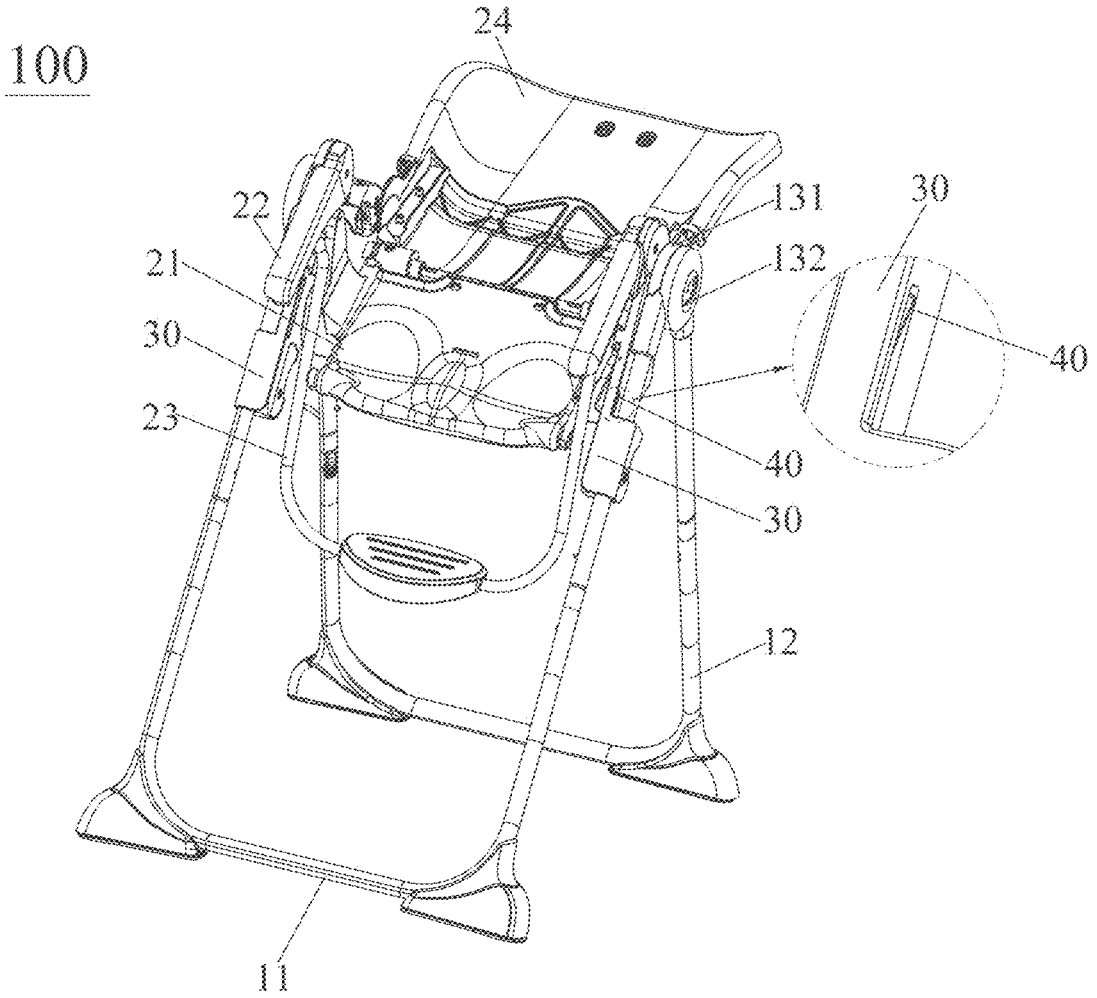
FIG. 15 is a diagram of the child carrier in FIG. 14 when a seat is folded up to a position.

Specifically, the child carrier 100 includes a blocking member 40. The blocking member 40 is movably assembled with the sliding base 30 to be movable relative to the sliding base 30 at least between a blocking position as shown in FIG. 14 and a releasing position as shown in FIG. 15. The sliding base 30 is blocked in an upward direction when the blocking member 40 is located at the blocking position, and the sliding base 30 is able to slide upward when the blocking member 40 is located at the releasing position. In a variant embodiment, the blocking member 40 is coupled to the supporting frame 10 and the upper end of the sliding base 30 to prevent the sliding base 30 from sliding upward in the blocking position, and the blocking member 40 is decoupled from the supporting frame 10 and the sliding base 30 to release the sliding base 30 to be slidable upward in the releasing position. To be more specific, when the blocking member 40 is located at the blocking position as shown in FIG. 14, the blocking member 40 abuts against the supporting frame 10. In this embodiment, the blocking member 40 abuts against a first fixed portion 131 of the foldable joint 13 for preventing upward sliding of the sliding base 30. As such, the blocking member 40 can prevent the sliding base 30 from driving the supporting frame 10 to be folded up when the seat 20 is in an unfolded state. When the blocking member 40 is located at the releasing position as shown in FIG. 15, the blocking member 40 is separate from the supporting frame 10. In this embodiment, the blocking member 40 is separate from the first fixed portion 131 to make the sliding base 30 slidable upward.

Figure 11:
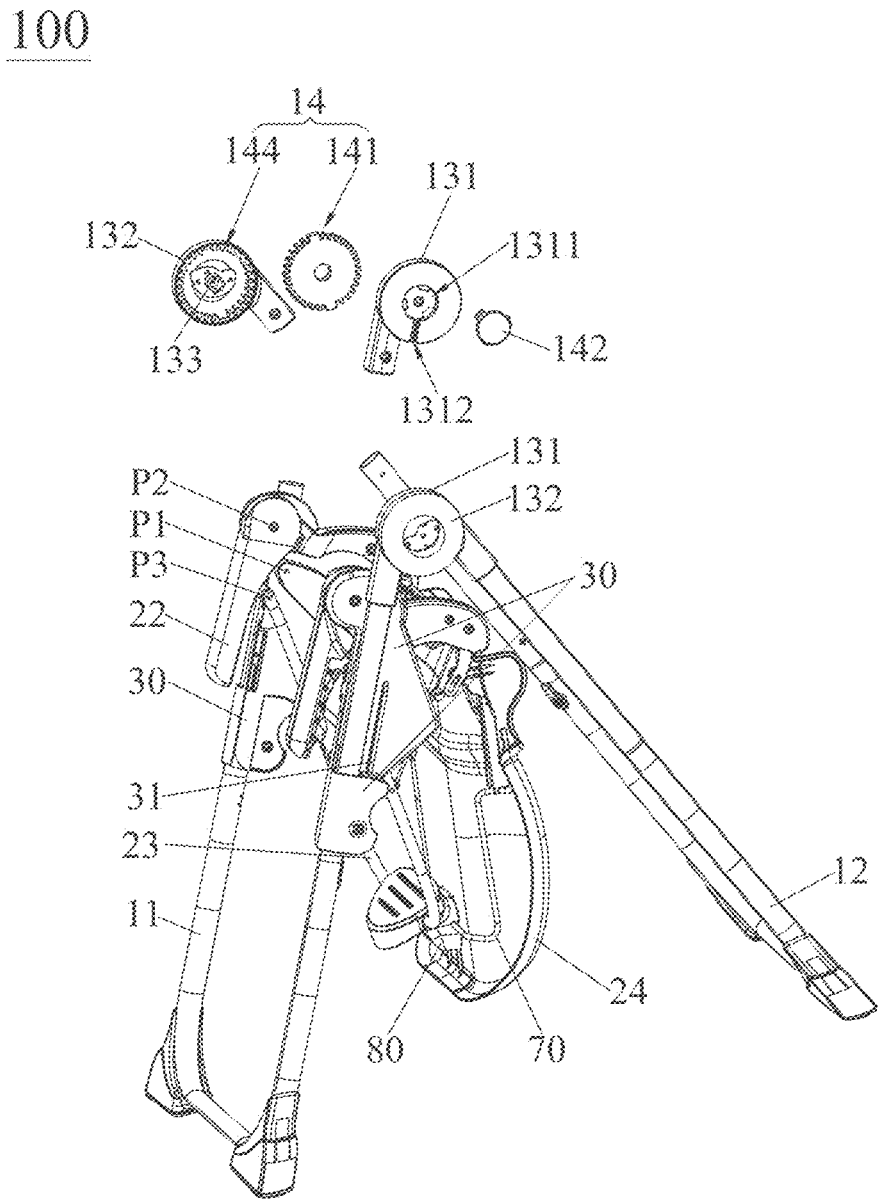
FIG. 11 is a partial exploded diagram of the child carrier in FIG. 10.

The seat 20 is movable relative to the sliding base 30 at least between a folding position as shown in FIG. 11 and an unfolding position as shown in FIG. 14. When the seat 20 is located at the unfolding position as shown in FIG. 14, the seat 20 drives the blocking member 40 to move from the releasing position to the blocking position. At this time, the blocking member 40 abuts against the supporting frame 10 to stop the sliding base 30 from sliding upward. When the seat 20 is switched to the folding position as shown in FIG. 11, the seat 20 is separate from the blocking member 40 to make the blocking member 40 selectively switchable to the releasing position. That is, the blocking member 40 is separate from the supporting frame 10 for allowing the sliding base 30 to slide upward. Accordingly, the seat 20 and the supporting frame 10 can be folded up sequentially for ensuring the folding sequence of the seat 20 and the supporting frame 10, but not limited thereto.

To be more specific, as shown in FIGS. 1-5 and FIGS. 7-15, the supporting frame 10 includes a first standing frame 11, a second standing frame 12, a foldable joint 13 connected to the first standing frame 11 and the second standing frame 12, and a locking mechanism 14 disposed on the foldable joint 13 for selectively locking or releasing the foldable joint 13. The first standing frame 11 is pivotably engaged with the second standing frame 12 via the foldable joint 13 and the locking mechanism 14. The sliding base 30 is slidably disposed on the first standing frame 11 and has an unlocking driving member 31. The unlocking driving member 31 drives the locking mechanism 14 to perform a releasing motion when the sliding base 30 slides upward along the first standing frame 11, so as to achieve the purpose that the foldable joint 13 can be released by the sliding base 30 to fold up the first standing frame 11 relative to the second standing frame 12. Specifically, the foldable joint 13 is assembled with top portions of the first standing frame 11 and the second standing frame 12. In a variant embodiment, the first standing frame 11 and the second standing frame 12 could be a U-shaped structure with an opening facing upward, such as a U-shaped tube or a U-shaped rod (but not limited thereto). Correspondingly, the top portions at the left sides of the first standing frame 11 and the second standing frame 12 are assembled with one foldable joint 13, and the top portions at the right sides of the first standing frame 11 and the second standing frame 12 are assembled with another foldable joint 13. That is, the foldable joints 13 are disposed at the left and right sides of the supporting frame 10 respectively (but not limited thereto), so as to reduce the overall weight of the supporting frame 10, simplify the structural design of the child carrier 100, and ensure the support reliability of the supporting frame 10.

Figure 16:
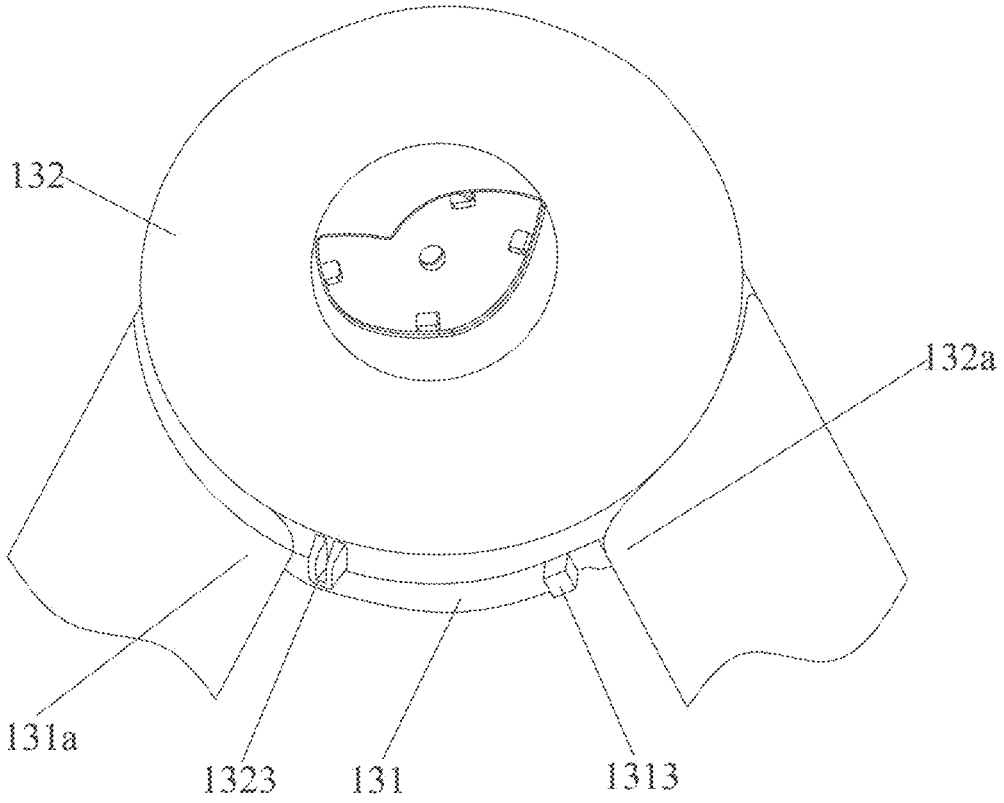
FIG. 16 is a partial diagram of a first fixed portion having a first rib formed thereon being assembled with a second fixed portion having a second rib formed thereon.

To be more specific, the foldable joint 13 includes a first fixed portion 131 and a second fixed portion 132. The first fixed portion 131 is pivoted to the second fixed portion 132 via a pivot shaft 133. The top portion of the first standing frame 11 is assembled with the first fixed portion 131, and the top portion of the second standing frame 12 is assembled with the second fixed portion 132. In a variant embodiment, the first fixed portion 131 is overlapped with the second fixed portion 132 in a direction indicated by a bidirectional arrow A in FIG. 6. The first fixed portion 131 is located at an inner side of the supporting frame 10 and the second fixed portion 132 is located at an outer side of the supporting frame 10 (but not limited thereto). The aforesaid configuration can further improve the folding reliability of the supporting frame 10. For example, as shown in FIG. 16, for preventing excessive folding of the first fixed portion 131 and the second fixed portion 132, the first fixed portion 131 has a first rib 1313 formed thereon, and the second fixed portion 132 has a second rib 1323 formed thereon. The first rib 1313 abuts against the second rib 1323 when the first fixed portion 131 and the second fixed portion 132 are folded up to a predetermined position (e.g. a position where the first standing frame 11 is substantially parallel to the second standing frame 12, but not limited thereto). In a variant embodiment, the first rib 1313 is adjacent to a portion 131*a* of the first fixed portion 131 assembled with the first standing frame 11, and the second rib 1323 is adjacent to a portion 132*a* of the second fixed portion 132 assembled with the second standing frame 12. To be noted, the related description for the foldable joint mechanical design of the pivot shaft 133, the first fixed portion 131 and the second fixed portion 132 is well known in the prior art and omitted herein.

Figure 6:
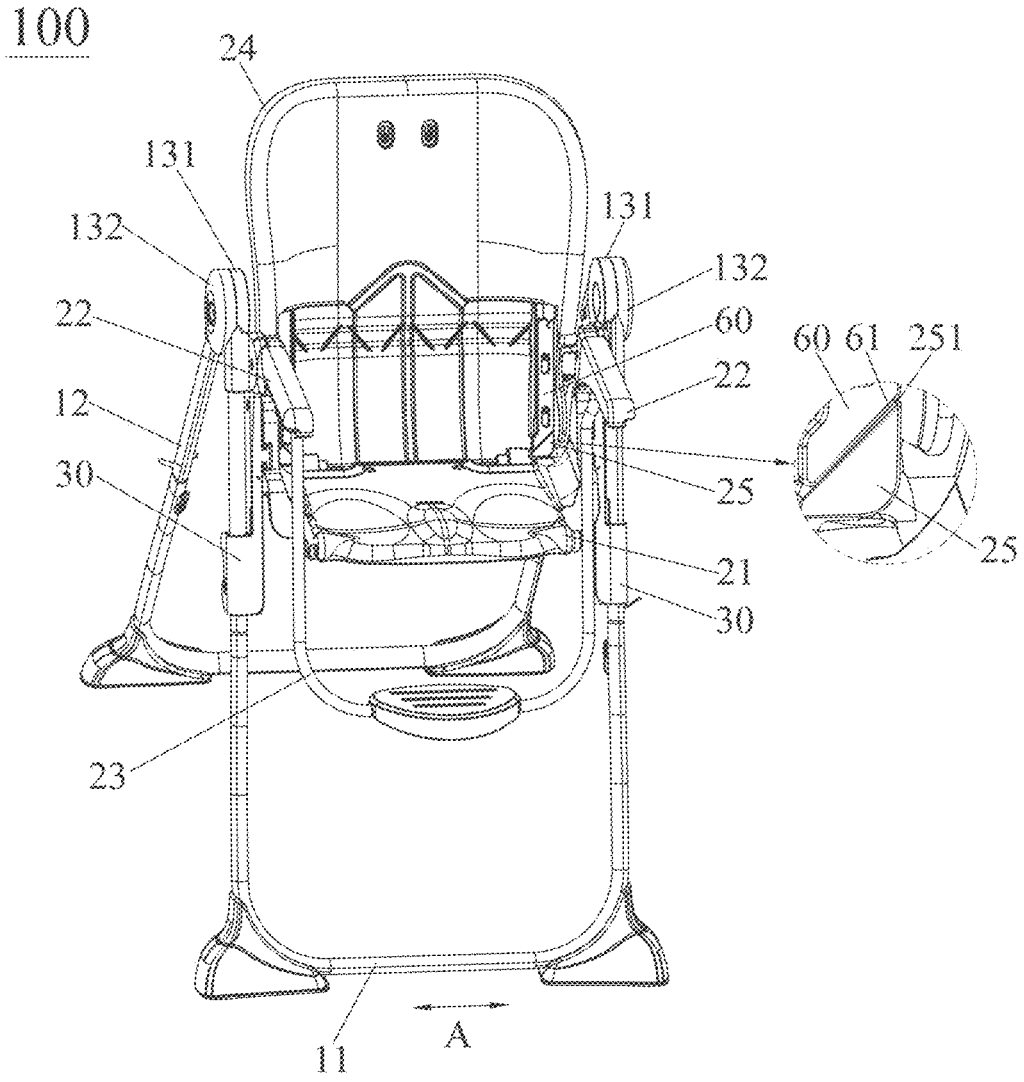
FIG. 6 is a diagram of the child carrier in FIG. 4 from anther viewing angle.

As shown in FIG. 11, the locking mechanism 14 includes a locking member 141 located between the first fixed portion 131 and the second fixed portion 132 along an axial direction of the pivot shaft 133 (i.e. the direction indicated by the bidirectional arrow A in FIG. 6), a releasing member 142 moving together with the locking member 141, a locking portion (not shown in the figures) disposed on the first fixed portion 131, and a locking portion 144 disposed on the second fixed portion 132. The locking member 141 slidably jackets the pivot shaft 133. The locking member 141 locks the foldable joint 13 to lock the supporting frame 10 in a using position when being engaged with the locking portion on the first fixed portion 131 and the locking portion 144, so as to prevent folding of the first standing frame 11 relative to the second standing frame 12. The unlocking driving member 31 drives the releasing member 142 to release engagement between the locking member 141 and the locking portion 144 for releasing the foldable joint 13 when the sliding base 30 slides upward. As such, the foldable joint 13 can be foldable for allowing folding of the first standing frame 11 relative to the second standing frame 12 to fold the supporting frame 10 in a folded position. In another embodiment, the unlocking driving member 31 could drive the releasing member 142 to release engagement between the locking member 141 and the locking portion on the first fixed portion 131, or could drive the releasing member 142 to disengage the locking member 141 from the locking portion on the first fixed portion 131 and the locking portion 144 simultaneously.

Specifically, an end portion of the first fixed portion 131 opposite to the second fixed portion 132 has a containing chamber 1311 formed thereon and a guiding slot 1312 communicated with the containing chamber 1311. The guiding slot 1312 extends in a radial direction of the pivot shaft 133 to be aligned with the unlocking driving member 31. The releasing member 142 is located in the containing chamber 1311. In a variant embodiment, the releasing member 142 could be a round block structure to be located in the containing chamber 1311 more steadily, and the releasing member 142 could be slidably disposed through the first fixed portion 131 in a longitudinal direction of the pivot shaft 133. Accordingly, the unlocking driving member 31 can slide toward the containing chamber 1311 via guidance of the guiding slot 1312 when the sliding base 30 slides upward along the first standing frame 11, so as to push the releasing member 142 to slide toward the first fixed portion 131. In such a manner, the releasing member 142 can drive the locking member 141 to slide away from the locking portion 144 for releasing the foldable joint 13. When the sliding base 30 drives the unlocking driving member 31 to slide downward, the releasing member 142 can return to its original position together with the locking member 141 via a returning member (not shown in the figures). The returning member could be a spring for providing a returning force to the releasing member 142 and the locking member 141 via compressed, torsional or stretch deformation. The unlocking driving member 31 could be a rib, a rod, a block, or a sheet. The locking member 141 could be an external gear and the locking portion on the first fixed portion 131 and the locking portion 144 could be an internal gear (but not limited thereto), so as to make the locking member 141 engaged with or disengaged from the locking portion on the first fixed portion 131 and the locking portion 144 more smoothly. It could be understood that the locking mechanism 14 could include the locking member 141, the releasing member 142 moving together with the locking member 141, and a locking portion (could be regarded as the aforesaid locking portion 144) for engaging with the locking member 141 in another embodiment. The locking portion is disposed on the second fixed portion 132, and the locking member 141 is movably disposed on the first fixed portion 131. In a variant embodiment, the locking member 141 could be slidable between the first fixed portion 131 and the second fixed portion 132 in the longitudinal direction of the pivot shaft 133. In such a manner, the locking member 141 can lock the foldable joint 13 when being engaged with the locking portion. On the other hand, the unlocking driving member 31 can drive the releasing member 142 to move the locking member 141 to be disengaged from the locking portion when the sliding base 30 slides upward, so as to release the foldable joint 13. In another embodiment, the locking member 141 could be slidably disposed on the second fixed portion 132 and the locking portion is disposed on the first fixed portion 131.

As shown in FIGS. 14-15, the blocking member 40 is pivoted to the sliding base 30, so that the blocking member 40 can be pivotable leftward and rightward relative to the sliding base 30 between the blocking position and the releasing position. As such, the seat 20 can drive the blocking member 40 from the releasing position to the blocking position more smoothly. In another embodiment, the blocking member 40 could be slidably disposed on the sliding base 30, so that the blocking member 40 could slide leftward and rightward relative to the sliding base 30 between the blocking position and the releasing position. Specifically, the child carrier 100 could further include a returning member (not shown in the figures) having a tendency to drive the blocking member 40 from the blocking position to the releasing position. The returning member drives the blocking member 40 to the releasing position when the seat 20 is switched to the folding position, meaning that the blocking member 40 can be switched from the blocking position to the releasing position accordingly with the folding operation of the seat 20, so as to improve the operational convenience of the child carrier 100. For example, the returning member could be a spring for providing a returning force to the blocking member 40 via compressed, torsional or stretch deformation, but not limited thereto. In another embodiment, an elastic sheet structure (not shown in the figures) is fixed on the sliding base 30. The elastic sheet structure extends from the sliding base 30, and the blocking structure 40 is formed on a free end of the elastic sheet structure. As such, the blocking structure 40 can be switched between the blocking position and the releasing position via elastic deformation of the elastic sheet structure for achieving the aforesaid switching purpose.

As shown in FIGS. 1-15, the seat 20 includes a seat portion 21, a handrail base 22, a link member 23, and a tray 27. The link member 23, the seat portion 21, the handrail base 22 and the sliding base 30 cooperatively form a four bar linkage mechanism for folding and unfolding of the child carrier 100, and the tray 27 is detachably mounted on the handrail base 22. Accordingly, a user can perform folding and unfolding operations of the seat portion 21 relative to the sliding base 30 conveniently via the link member 23 when the tray 27 is detached from the handrail base 22. Specifically, the seat portion 21 is pivoted to the sliding base 30 at a first pivot point P1. The handrail base 22 is pivoted to the sliding base 30 at a second point P2 located above the first pivot point P1. The link member 23 is pivoted to the handrail base 22 at a third pivot point P3 located in front of the second pivot point P2. The link member 23 is pivoted to the seat portion 21 at a fourth point P4 located under the third pivot point P3. In a variant embodiment, as shown in FIG. 9, the first pivot point P1 is located at an upper end of the seat portion 21, the second pivot point P2 is located at a rear end of the handrail base 22, the third pivot point P3 is located at a middle portion of the handrail base 22, and the fourth pivot point P4 is located at a front end of the seat portion 21, so as to ensure folding smoothness of the seat portion 21 relative to the sliding base 30. To be more specific, the handrail bases 22 and the sliding bases 30 are located at left and right sides of the seat portion 21, the link member 23 is a U-shaped structure (e.g. a U-shaped tube or a U-shaped rod, but not limited thereto) having an opening facing upward. A top portion at the left side of the U-shaped structure is pivoted to the handrail base 22 located at the left side of the seat 20, a top portion at the right side of the U-shaped structure is pivoted to the handrail base 22 located at the right side of the seat 20, and a front end of the seat portion 21 is pivoted to the U-shaped part (but not limited thereto), so as to improve the linkage reliability of the seat portion 21, the link member 23, the handrail base 22 and the sliding base 30. It could be understood that the tray 27 could be omitted according to the practical application, which means the seat 20 could only include the seat portion 21, the handrail base 22 and the link member 23 in another embodiment.

Figure 2:
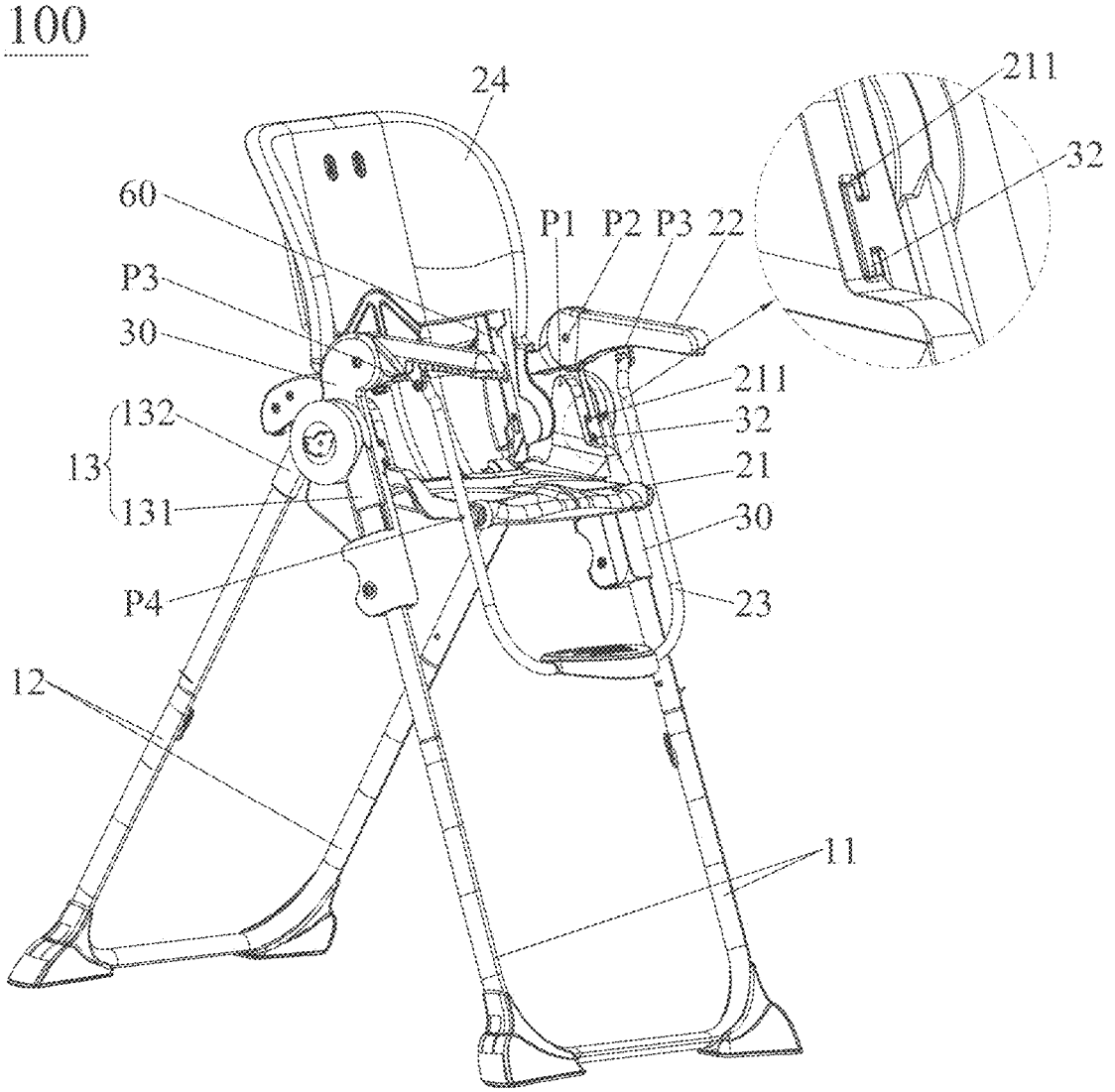
FIG. 2 is a diagram of the child carrier after a tray is detached.
Figure 3:
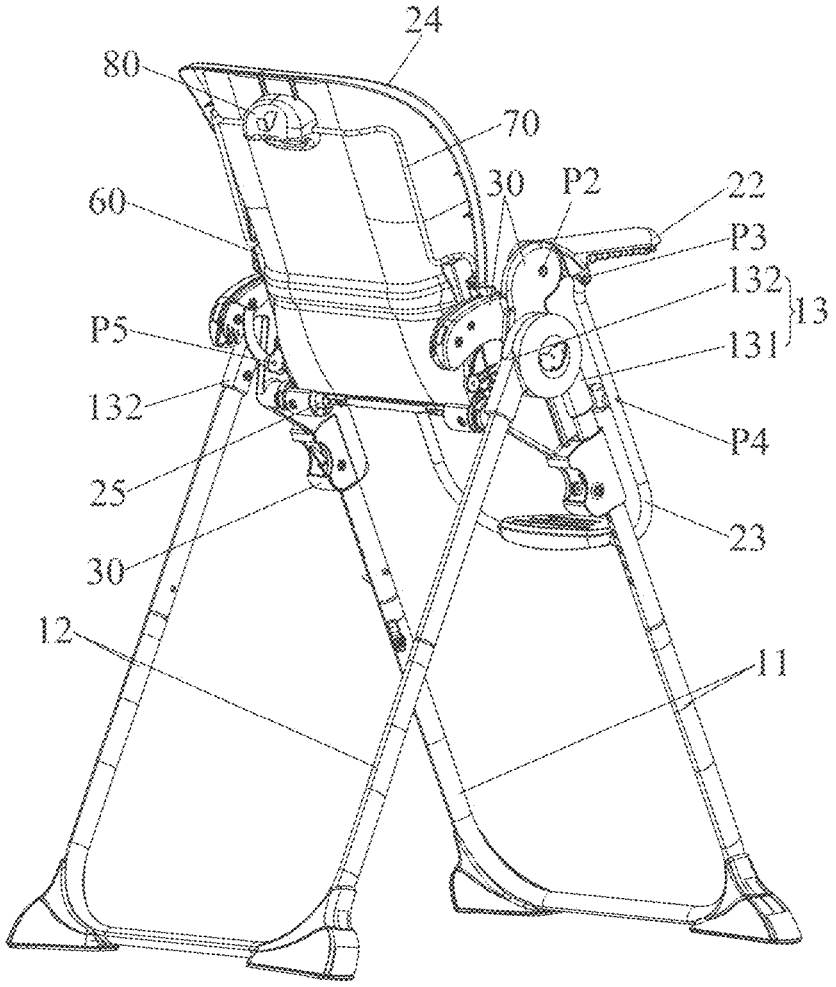
FIG. 3 is a diagram of the child carrier in FIG. 2 from anther viewing angle.

As shown in FIG. 2 and FIG. 9, an engaging slot 211 is formed on the seat portion 21, and an engaging rail 32 is formed on the sliding base 30 corresponding to the engaging slot 211. The engaging rail 32 is separate from the engaging slot 211 after folding of the seat 20 as shown in FIG. 9. The engaging rail 32 is engaged with the engaging slot 211 after unfolding of the seat 20 as shown in FIG. 2. Accordingly, when the seat 20 is unfolded, engagement of the engaging rail 32 and the engaging slot 211 provides a steadier support to the seat portion 21. Specifically, the engaging slot 211 is formed at a middle portion of a side wall of the seat portion 21 facing the sliding base 30. To be noted, the engaging slot 211 could be disposed on the sliding base 30 and the engaging rail 32 could be disposed on the seat portion 21 in another embodiment.

Figure 4:
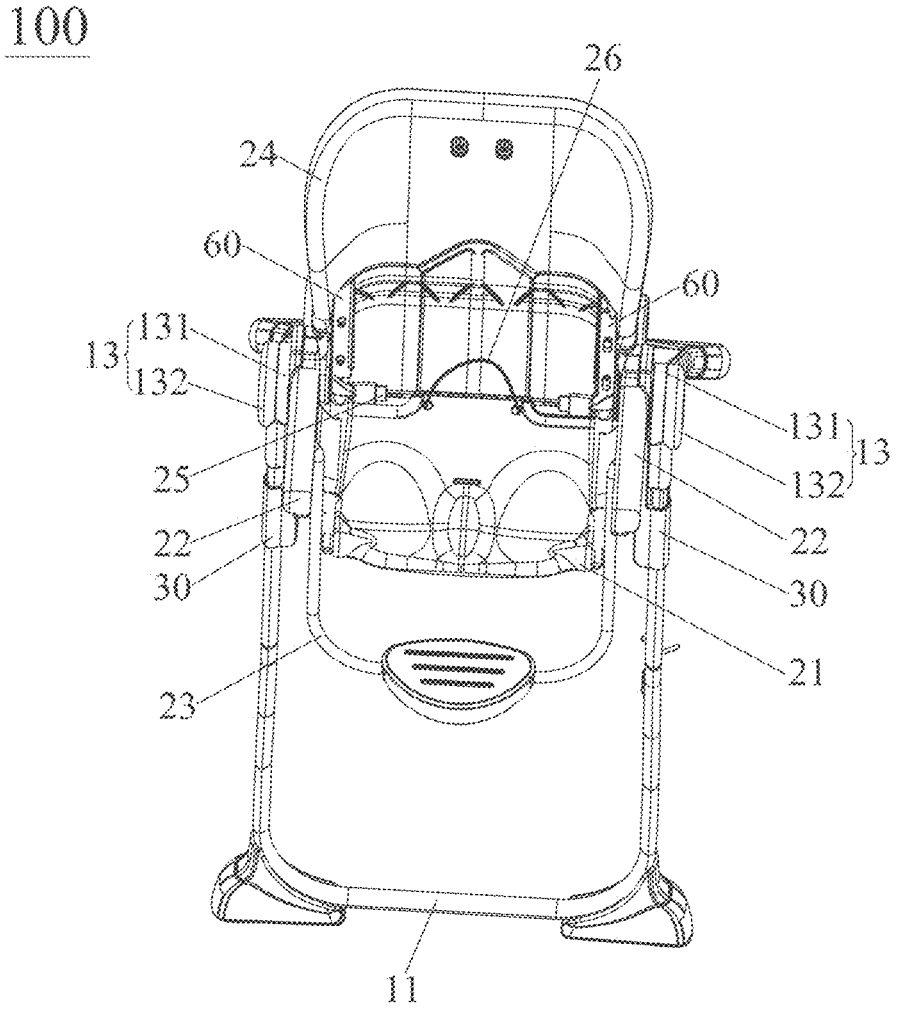
FIG. 4 is a diagram of the child carrier in FIG. 2 from anther viewing angle.
Figure 5:
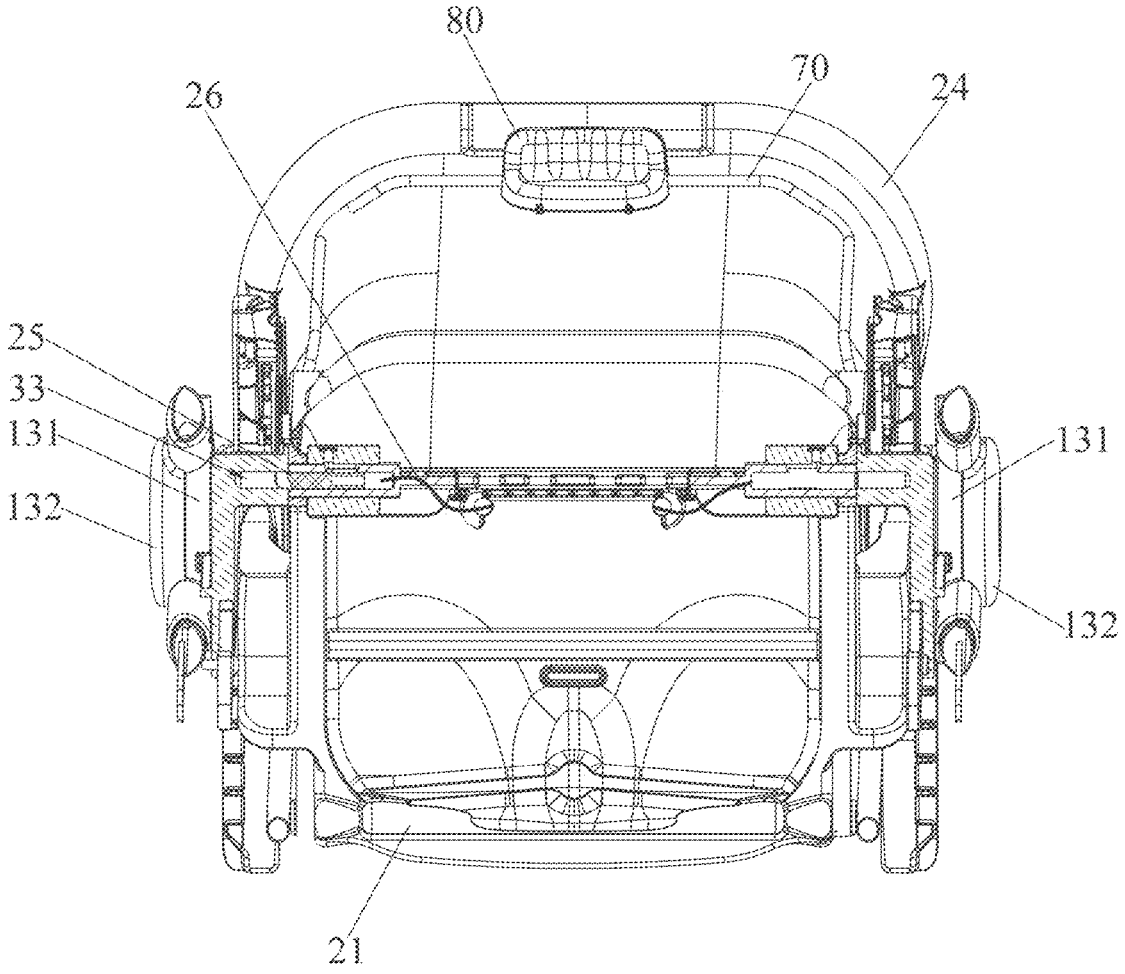
FIG. 5 is a cross-sectional diagram of the child carrier in FIG. 3 along a plane in a left-right direction of the child carrier.
Figure 7:
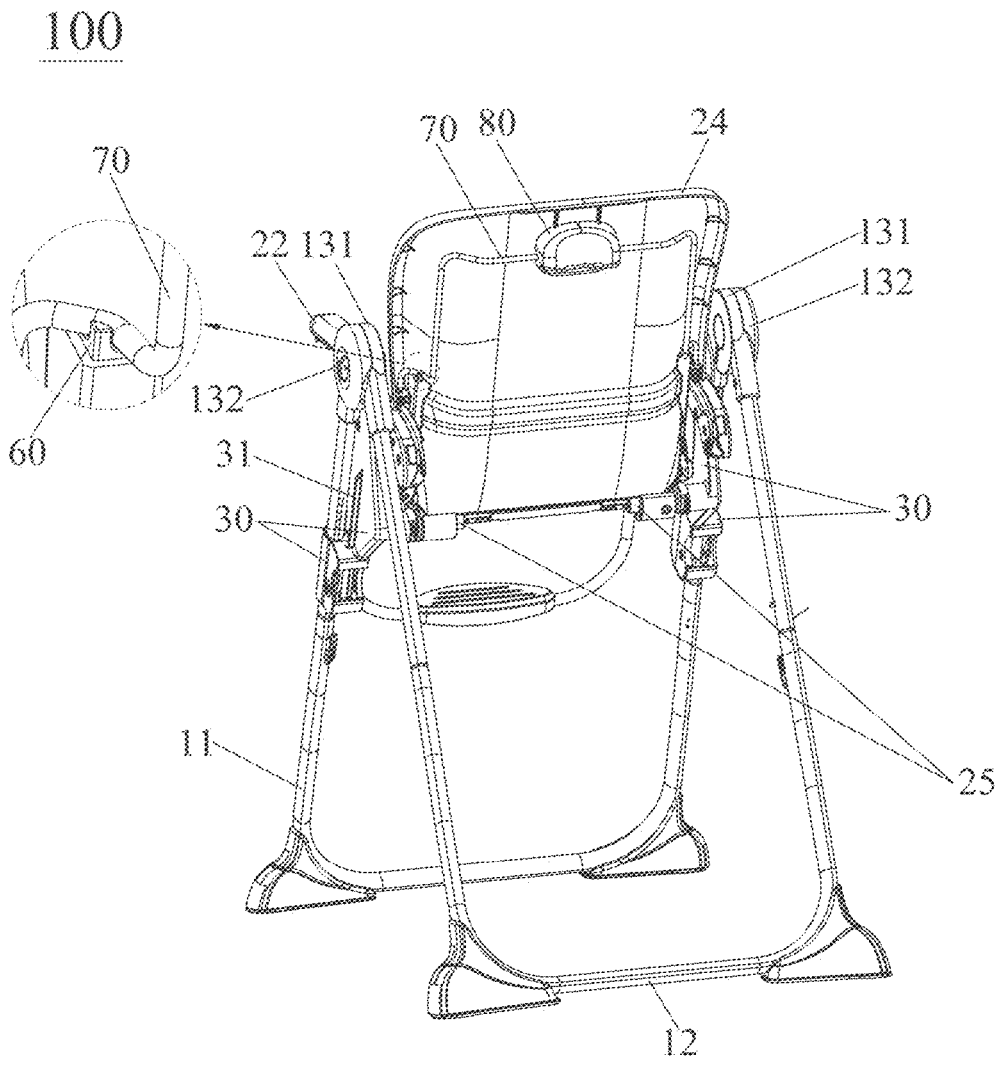
FIG. 7 is a diagram of the child carrier in FIG. 4 from anther viewing angle.
Figure 8:
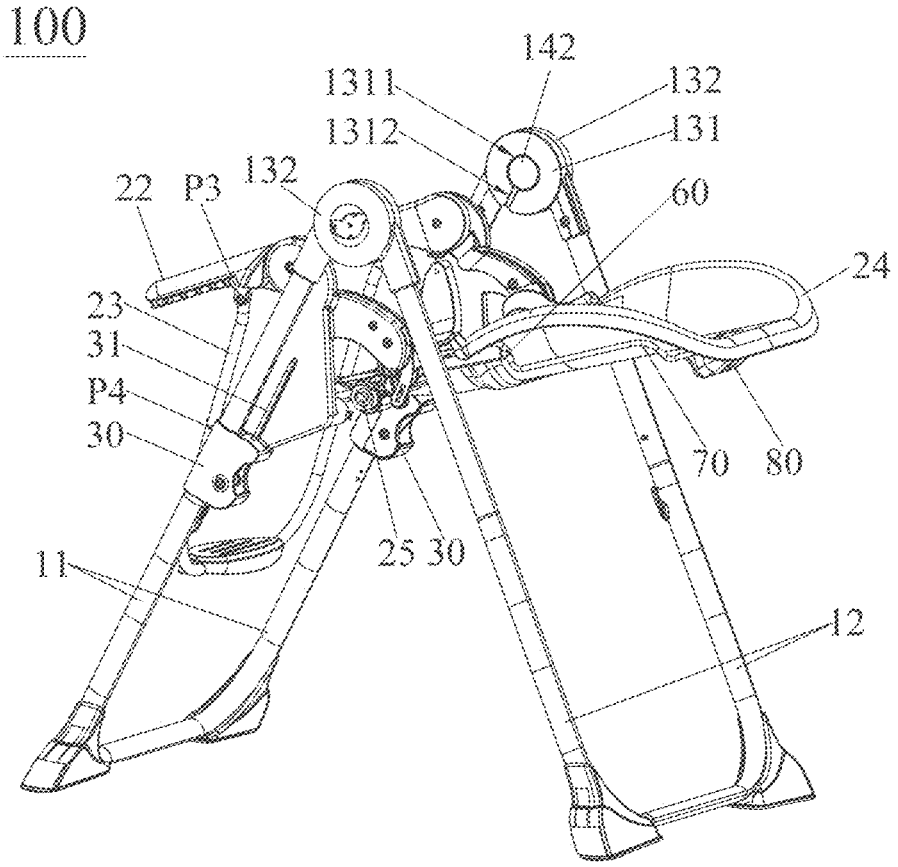
FIG. 8 is a diagram of the child carrier in FIG. 3 when the seat is folded up to a position.
Figure 9:
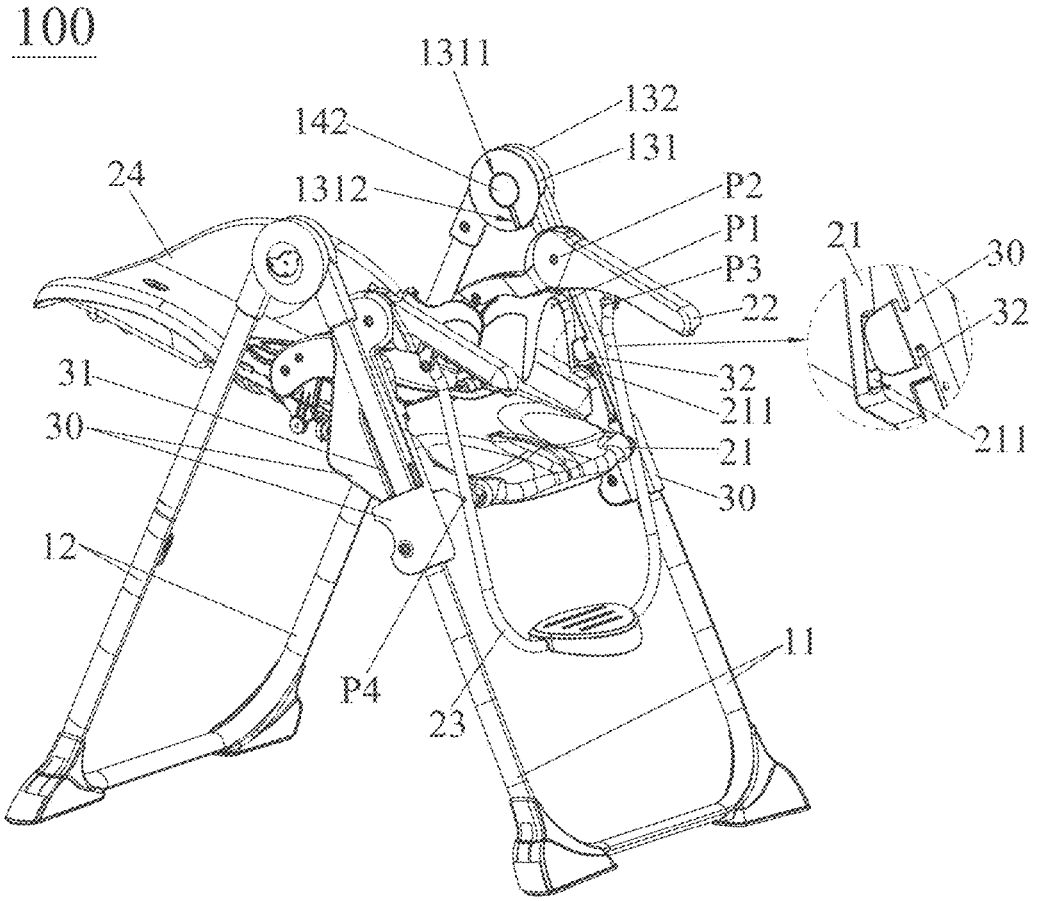
FIG. 9 is a diagram of the child carrier in FIG. 8 from anther viewing angle.

As shown in FIG. 4 and FIG. 8, the seat portion 21 has an engaging member 25 and a pulling member 26 connected to the engaging member 25. The sliding base 30 has an engaging slot 33 for engaging with an engaging portion of the engaging member 25. The engaging member 25 is disposed on the child carrier 100 and is slidable in the direction indicated by the bidirectional arrow A to be selectively engaged with or disengaged from the engaging slot 33, so that the seat portion 21 can be driven to be folded or unfolded relative to the sliding base 30 when the user operates the link member 23. Specifically, as shown in FIG. 4 and FIG. 5, the engaging members 25 are located at two sides of the seat portion 21 respectively. An end of the pulling member 26 is connected to the engaging member 25 located at the left side of the seat portion 21, and the other end of the pulling member 26 is connected to the engaging member 25 located at the right side of the seat portion 21. A middle section of the pulling member 26 could be exposed above the seat portion 21 for the user to operate the pulling member 26 conveniently for simultaneously releasing the engaging members 25 located at the two sides of the seat portion 21, but not limited thereto. To be noted, the engaging member 25 and the pulling member 26 could be disposed on the sliding base 30 and the engaging slot 33 could be disposed on the seat portion 21 correspondingly in another embodiment. Furthermore, as shown in FIG. 2, FIG. 6, and FIG. 7, the seat 20 further includes a backrest portion 24. A side wall of the backrest portion 24 is pivoted to the sliding base 30 at a fifth pivot point P5. In a variant embodiment, the engaging portion of the engaging member 25 could extend from an axis to engage with the sliding base 30, and the axis is the same as the axis where the seat portion 21 and the backrest portion 24 are hinged to engage with the sliding base 30.

For synchronously releasing the seat portion 21 and the backrest portion 24, the child carrier 100 could further include a pushing member 60 and an insert member 70. The pushing member 60 is disposed on the backrest portion 24 and is slidable upward and downward relative to the backrest portion 24. The insert member 70 is in an inverted-U shape for selectively engaging with or disengaging from the sliding base 30. The insert member 70 is disposed on the backrest portion 24 and is slidable upward and downward relative to the backrest portion 24. An upper end of the pushing member 60 abuts against the insert member 70, and a lower end of the pushing member 60 is connected to the engaging member 25. In such a manner, when the engaging member 25 is disengaged from the engaging slot 33 of the sliding base 30, the pushing member 60 can push the insert member 70 to be disengaged from the sliding base 30, so as to achieve the purpose that the seat portion 21 and the backrest portion 24 can be folded up synchronously.

To be more specific, a driving portion of the engaging member 25 has a first inclined surface 251 oblique to a sliding direction of the engaging member 25 (i.e. the direction indicated by the bidirectional arrow A), and the pushing member 60 has a second inclined surface 61 matching with the first inclined surface 251. As such, the driving portion of the engaging member 25 can drive the pushing member 60 to slide upward via relative sliding of the first inclined surface 251 on the second inclined surface 61, so as to achieve the purpose that the engaging member 25 can move together with the pushing member 60 and ensure that the pushing member 60 can slide upward and downward on the backrest portion 24 via the engaging member 25 for folding or unfolding of the seat 20. In a variant embodiment, the insert member 70 could be located at a back surface of the backrest portion 24 and the pushing member 60 could be located at a front surface of the backrest portion 24, but not limited thereto. In this embodiment, the insert member 70 could be an iron wire or a steel wire to ensure the locking reliability of the insert member 70 for the backrest portion 24 and the sliding base 30, and the pulling member 26 could be a braided strap or a rope for easy assembly and convenient operation of the pulling member 26. The backrest portion 24 could further have an actuator 80 connected to a top end of the insert member 70. The actuator 80 drives the insert member 70 to be engaged with or disengaged from the sliding base 30 for angle adjustment of the backrest portion 24. In a variant embodiment, the actuator 80 could be located adjacent to a top portion of the back surface of the backrest portion 24 for driving the insert member 70 to move a first distance, therefore, the insert member 70 is able to disengage from the sliding base 30, and the backrest portion 24 is movable related to the seat portion 21, in particular, for the reclining angle adjustment. A returning spring is disposed in the actuator 80 to provide a returning force to the actuator 80 for returning the insert member 70 to its original position automatically when the actuator 80 is released. In a variant embodiment, when the driving portion of the engaging member 25 drives the pushing member 60 to slide upward via relative sliding of the first inclined surface 251 on the second inclined surface 61, the driving portion of the engaging member 25 is able to drive the insert member 70 to move a second distance. To prevent accidental folding of the seat 20 during angle adjustment of the backrest portion 24, in a variant embodiment, the second distance may be set longer than the first distance. When the user operates the actuator 80, the insert member 70 can only move the first distance to disengage from the sliding base 30 to have an angle adjustment of the backrest portion 24, however, by providing a blocker (not shown in figures) at the height of the first distance, the backward adjustment of backrest portion 24 cannot be continued. When the user operates the pulling member 26, the insert member 70 is driven to move the second distance higher than the height of the blocker, the backrest portion 24 can be folded down backward without hindrance. Therefore, by providing the first distance and the second distance in the different insert member operating mechanisms, the operation safety of the child carrier 100 can be effectively improved.

Figure 10:
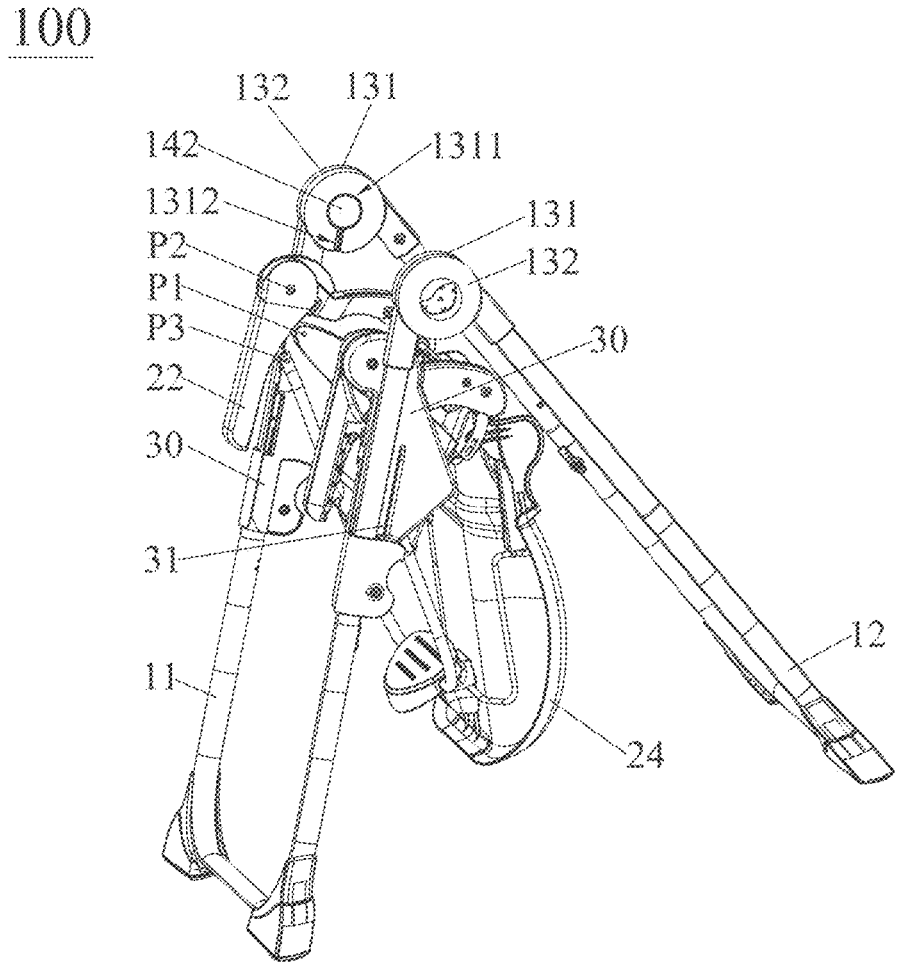
FIG. 10 is a diagram of the child carrier in FIG. 8 being further folded up.
Figure 12:
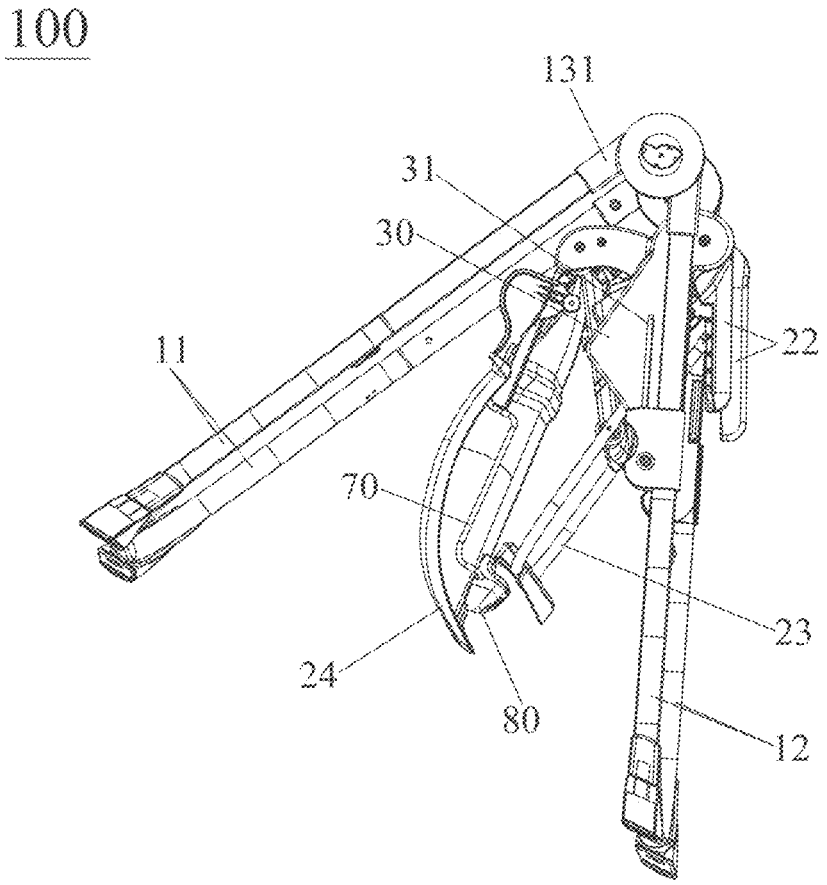
FIG. 12 is a diagram of the child carrier in FIG. 8 from anther viewing angle.

More detailed description for the folding and unfolding operations of the child carrier 100 is provided as follows with the attached drawings. If the user wants to fold up the child carrier 100 from the unfolded state as shown in FIG. 2 to the folding state as shown in FIG. 13, the user just needs to pull the pulling member 26 to disengage the engaging member 25 from the engaging slot 33 for releasing locking between the seat portion 21 and the sliding base 30. At this time, the engaging member 25 can drive the pushing member 60 to slide upward via relative sliding of the first inclined surface 251 on the second inclined surface 61 when being disengaged from the engaging slot 33. With upward sliding of the pushing member 60, the insert member 70 can be pushed to slide upward, so as to be separate from the sliding base 30 for releasing locking between the backrest portion 24 and the sliding base 30. As such, the user can perform the folding operations of the seat portion 21 and the backrest portion 24 relative to the sliding base 30 respectively. Subsequently, the user can keep pulling the pulling member 26 and drive the link member 23 to move rearward and downward. At the same time, with rearward and downward movement of the link member 23, the seat portion 21 can drive the backrest portion 24 to rotate rearward and downward, so as to fold up the backrest portion 24 and the seat portion 21 to collapse together as shown in FIGS. 10-12. Afterward, the user can pull the seat 20 upward to slide the sliding base 30 upward along the first standing frame 11, so as to move the unlocking driving member 31 of the sliding base 30 close to the releasing member 142 via guidance of the guiding slot 1312. Finally, the unlocking driving member 31 can push the releasing member 142 to move the locking member 141 away from the locking portion 144 for releasing the foldable joint 13, so that the first standing frame 11 and the second standing frame 12 can be folded up as shown in FIG. 13 to complete the folding operation of the supporting frame 10.

Compared with the prior art, the present invention adopts the design in which the sliding base 30 is disposed on the supporting frame 10 and is slidable longitudinally along the supporting frame 10 and the seat 20 is foldably assembled with the sliding base 30. In such a manner, when the sliding base 30 slides upward along the supporting frame 10, the seat 20 can be folded up together with the sliding base 30 and the sliding base 30 can drive the supporting frame 10 to be folded up synchronously, so as to quickly complete the folding operation of the child carrier 100. Thus, it is very easy for the user to perform the folding operation of the child carrier 100, so as to improve the operational convenience of the child carrier 100.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A child carrier comprising:

a supporting frame;

a sliding base disposed on the supporting frame and slidable in a substantially longitudinal direction of the supporting frame;

a seat foldably assembled with the sliding base;

a foldable joint disposed on the supporting frame; and a locking mechanism disposed on the foldable joint for selectively locking the foldable joint;

wherein the locking mechanism is driven by the sliding base to release the foldable joint when the sliding base slides upward along the supporting frame, so that the supporting frame is driven to be folded up by the sliding base.

2. The child carrier of claim 1, wherein the seat comprises:

a backrest portion movably pivoted to the sliding base; and a seat portion coupled to the backrest portion and selectively coupled to the sliding base;

wherein the backrest portion is rotatable relative to the seat portion when the seat portion is decoupled from the sliding base.

3. The child carrier of claim 2, wherein the seat portion comprises an engaging member having an engaging portion, and the engaging portion is operable to engage with the sliding base.

4. The child carrier of claim 2, wherein the seat portion comprises two engaging members located at left and right sides of the seat respectively and a pulling member having an end connected to the engaging member located at the left side of the seat, another end of the pulling member is connected to the engaging member located at the right side of the seat, and a middle portion of the pulling member is exposed above the seat portion.

5. The child carrier of claim 4, wherein the pulling member is a braided strap or a rope.

6. The child carrier of claim 3, wherein the engaging portion extends from an axis to engage with the sliding base, and the axis is the same as an axis where the seat portion and the backrest portion are hinged to engage with the sliding base.

7. The child carrier of claim 3, wherein the child carrier further comprises:

an insert member disposed on the backrest portion for selectively engaging with or disengaging from the sliding base; and an actuator operable to drive the insert member to be engaged with or be disengaged from the sliding base;

wherein the actuator is able to drive the insert member to move a first distance.

8. The child carrier of claim 7, wherein the engaging member further has a driving portion, the driving portion is able to drive the insert member to move a second distance, and the second distance is longer than the first distance.

9. The child carrier of claim 7, wherein the insert member is an iron wire or a steel wire.

10. The child carrier of claim 8, wherein the child carrier further comprises a pushing member disposed on the backrest portion and slidable upward and downward relative to the backrest portion, the pushing member has an upper end abutting against the insert member and a lower end coupling to the driving portion of the engaging member, and the pushing member is driven to push the insert member to be disengaged from the sliding base and move the second distance when the engaging member is disengaged from the sliding base.

11. The child carrier of claim 10, wherein the driving portion of the engaging member has a first inclined surface oblique to a sliding direction of the engaging member, the pushing member has a second inclined surface matching with the first inclined surface, and the driving portion drives the pushing member to slide upward via relative sliding of the first inclined surface on the second inclined surface.

12. The child carrier of claim 2, wherein the seat further comprises a handrail base and a link member, and the link member, the seat portion, the handrail base and the sliding base cooperatively form a four bar linkage mechanism for performing a folding motion.

13. The child carrier of claim 12, wherein the seat portion is pivoted to the sliding base at a first pivot point, the handrail base is pivoted to the sliding base at a second pivot point located above the first pivot point, the link member is pivoted to the handrail base at a third pivot point located in front of the second pivot point, and the link member is pivoted to the seat at a fourth pivot point located under the third point.

14. The child carrier of claim 13, wherein the first pivot point is located at an upper end of the seat portion, the second pivot point is located at a rear end of the handrail base, the third pivot point is located at a middle portion of the handrail base, and the fourth pivot point is located at a front end of the seat portion.

15. The child carrier of claim 13, wherein the handrail base and the sliding base are located at left and right sides of the seat portion, the link member is a U-shaped structure having an opening facing upward, a top portion located at a left side of the U-shaped structure is pivoted to the handrail base at the left side of the seat portion, a top portion located at a right side of the U-shaped structure is pivoted to the handrail base at the right side of the seat portion, and a front end of the seat portion is pivotably disposed in the U-shaped structure.

16. The child carrier of claim 12, wherein an engaging slot is formed on one of the seat portion and the sliding base, an engaging rail is formed on the other of the seat portion and the sliding base corresponding to the engaging slot, the engaging rail is disengaged from the engaging slot after the seat is folded up, and the engaging rail is engaged with the engaging slot after the seat is unfolded.

17. The child carrier of claim 16, wherein the engaging rail or the engaging slot is located at a middle portion of a side wall of the seat portion facing the sliding base.

18. The child carrier of claim 1, wherein the supporting frame comprises a first standing frame and a second standing frame, the foldable joint comprises a first fixed portion and a second fixed portion, the locking mechanism comprises a locking portion, a locking member, and a releasing member, the second fixed portion is connected to the first fixed portion of the first standing frame on the foldable joint via a pivot shaft, the locking portion is disposed on one of the first fixed portion and the second fixed portion, the locking member is movably disposed on the other of the first fixed portion and the second fixed portion, the locking member is able to engage with the locking portion to lock the supporting frame in a using position, and the releasing member is operable to move relative to the locking member and release the locking member from the locking portion.

19. The child carrier of claim 1, wherein the supporting frame comprises a first standing frame and a second standing frame, the foldable joint comprises a first fixed portion and a second fixed portion, the locking mechanism comprises a locking member and a releasing member, the second fixed portion is connected to the first fixed portion of the first standing frame on the foldable joint via a pivot shaft, the locking member is movably disposed between the first fixed portion and the second fixed portion to lock the supporting frame in a using position, and the releasing member is operable to move relative to the locking member and release the locking member from at least one of the first fixed portion and the second fixed portion.

20. The child carrier of claim 18, wherein the child carrier further comprises:

an unlocking driving member disposed on the sliding base;

wherein the unlocking driving member drives the locking mechanism to perform a release motion when the sliding base slides upward along the supporting frame.

21. The child carrier of claim 20, wherein the unlocking driving member drives the releasing member to release the locking member from the locking portion for releasing the locking member or the foldable joint in the using position when the sliding base slides upward along the supporting frame.

22. The child carrier of claim 20, wherein the supporting frame further comprises:

a containing chamber disposed on the standing frame for containing the releasing member; and a guiding slot communicated with the containing chamber, the guiding slot extending in a radial direction of the pivot shaft to be aligned with the unlocking driving member;

wherein the unlocking driving member slides along the guiding slot to drive the releasing member to release the locking member from the locking portion when the sliding base slides upward along the supporting frame.

23. The child carrier of claim 20, wherein the unlocking driving member is a rib, a rod, a block, or a sheet.

24. The child carrier of claim 19, wherein the child carrier further comprises:

an unlocking driving member disposed on the sliding base;

wherein the unlocking driving member drives the locking mechanism to perform a release motion when the sliding base slides upward along the supporting frame.

25. The child carrier of claim 24, wherein the unlocking driving member drives the releasing member to release the locking member from the locking portion for releasing the locking member or the foldable joint in the using position when the sliding base slides upward along the supporting frame.

26. The child carrier of claim 24, wherein the supporting frame further comprises:

a containing chamber disposed on the standing frame for containing the releasing member; and a guiding slot communicated with the containing chamber, the guiding slot extending in a radial direction of the pivot shaft to be aligned with the unlocking driving member;

wherein the unlocking driving member slides along the guiding slot to drive the releasing member to release the locking member from the locking portion when the sliding base slides upward along the supporting frame.

27. The child carrier of claim 24, wherein the unlocking driving member is a rib, a rod, a block, or a sheet.

28. The child carrier of claim 18, wherein the locking member is an external gear, and the locking portion is an internal gear.

29. The child carrier of claim 18, wherein the first fixed portion has a first rib formed thereon, the second fixed portion has a second rib formed thereon, and the first rib abuts against the second rib when first fixed portion and the second fixed portion are folded up to a predetermined position.

30. The child carrier of claim 29, wherein the first rib is adjacent to a portion of the first fixed portion assembled with the first standing frame, and the second rib is adjacent to a portion of the second fixed portion assembled with the second standing frame.

31. The child carrier of claim 19, wherein the first fixed portion has a first rib formed thereon, the second fixed portion has a second rib formed thereon, and the first rib abuts against the second rib when first fixed portion and the second fixed portion are folded up to a predetermined position.

32. The child carrier of claim 31, wherein the first rib is adjacent to a portion of the first fixed portion assembled with the first standing frame, and the second rib is adjacent to a portion of the second fixed portion assembled with the second standing frame.

33. The child carrier of claim 1, wherein the child carrier further comprises a blocking member, the blocking member is movably assembled with the sliding base to be movable at least between a blocking position and a releasing position, the sliding base is blocked in an upward direction when the blocking member is located at the blocking position, and the sliding base is able to slide upward when the blocking member is located at the releasing position.

34. The child carrier of claim 33, wherein the blocking member is coupled to the supporting frame and an upper end of the sliding base to prevent the sliding base from sliding upward in the blocking position, and the blocking member is decoupled from the supporting frame and the sliding base to release the sliding base to be slidable upward in the releasing position.

35. The child carrier of claim 33, wherein the seat is movable at least between a folding position and an unfolding position relative to the sliding base, the seat drives the blocking member from the releasing position to the blocking position when the seat is located at the unfolding position, and the seat is separate from the blocking member to make the blocking member switchable to the releasing position when the seat is switched to the folding position.

36. The child carrier of claim 33, wherein an elastic sheet structure extends from the sliding base, the blocking member is formed on a free end of the elastic sheet structure, and the blocking member is switchable between the blocking position and the releasing position via elastic deformation of the elastic sheet structure.

37. The child carrier of claim 33, wherein the blocking member is pivoted to the sliding base or the blocking member is slidably disposed on the sliding base.

38. The child carrier of claim 37, wherein the blocking member rotates or slides leftward and rightward relative to the sliding base when the blocking member is switched between the blocking position and the releasing position.

39. The child carrier of claim 37, wherein the child carrier further comprises a returning member having a tendency to drive the blocking member from the blocking position to the releasing position, and the returning member drives the blocking member to the releasing position when the seat is switched to the folding position.

* * * * *